US006385925B1

(12) United States Patent
Wark

(10) Patent No.: US 6,385,925 B1
(45) Date of Patent: May 14, 2002

(54) WINDOW DRAIN

(75) Inventor: Scott Arthur Wark, 18228 Claytonhill Drive, Surrey, BC (CA), V3S 5M1

(73) Assignee: Scott Arthur Wark, Surrey (CA)

( * ) Notice: Subject to any disclaimer, the term of this patent is extended or adjusted under 35 U.S.C. 154(b) by 0 days.

(21) Appl. No.: 09/718,513

(22) Filed: Nov. 24, 2000

(30) Foreign Application Priority Data

Dec. 16, 1999 (CA) ..... 2292301

(51) Int. Cl.[7] ..... E06B 7/14

(52) U.S. Cl. ..... 52/209; 52/302.1; 52/302.6; 52/97; 52/98; 52/745.16; 52/204.5; 52/204.591; 49/408; 49/471; 49/476.1

(58) Field of Search ..... 52/209, 302.1, 52/302.6, 97, 98, 745.16, 204.5, 204.591; 49/408, 471, 476.1

(56) References Cited

U.S. PATENT DOCUMENTS

| | | | | | |
|---|---|---|---|---|---|
| 2,648,107 | A | * | 8/1953 | Bates, Jr. | 52/209 |
| 5,822,934 | A | * | 10/1998 | O'Donnell | 52/209 |
| 5,921,038 | A | * | 7/1999 | Burroughs et al. | 52/209 |
| 5,956,909 | A | * | 9/1999 | Chou | 52/209 |

* cited by examiner

*Primary Examiner*—Carl D. Friedman
*Assistant Examiner*—Chi Nguyen

(57) ABSTRACT

Window drain comprises, in general, a base having a horizontally extending lower surface and a sloping downwardly and outwardly upper surface. To the base are connected: a front flange, an upstanding rear rib, an end flange at each end, window supports and spacers attached on the front flange. In one embodiment, the window drain is made for a window of a specific width. In another embodiment, the window drain, is versatile so it can be used for windows of different widths. In a third embodiment, the window drain can be made, in situ, for different window widths.

8 Claims, 4 Drawing Sheets

WINDOW DRAIN

BACKGROUND OF THE INVENTION

1. Field of the Invention

This invention relates, in general, to drainage systems for buildings and, particularly, to a window drain.

2. Description of the Prior Art

In the wall construction for buildings, usually the sill of the window frame merely rests upon the boarding and, until now, no efficient devices to prevent the penetration of water or moisture under the window sill have been developed and successfully used. As a direct result, rain water infiltrates into under the sill and leaks down through the wall of the building and damages ceilings and plastered walls. If the house happens to be covered with a stucco finish, the water also enters between the furring and the stucco, so that the stucco becomes discolored and sometimes falls away beneath the window.

Despite various improvements in the existing window drains, the latter still suffer from drawbacks which are seemingly inherent in their basic concepts. For example, U.S. Pat. No. 2,648,107, granted on Aug. 11, 1953 to Bates for a "Drip deflector", discloses a device for attachment to a window frame. The device comprises an elongated rectangular attaching strip, adapted to be attached to the under side of a window sill. An elongated rectangular drip deflecting flange is carried by the attaching strip and projects outwardly and downwardly from a longitudinal side edge thereof and beyond the outer edge of the window sill.

Guards, carried by the flange, adjacent opposite ends, extend upwardly and downwardly for attachment to the stiles of the window frame. In its drip deflector configuration, Bates structure has a number of shortcomings. First, the sill of the window frame rests directly on the elongated rectangular attaching strip, thereby no space for collecting and, then, draining the water is provided. Second, since no rear upstanding rib or flange is used, the leakage of water towards the back of the window frame cannot be prevented. Third, the manner of attachment of the drip deflector to the sill of the window frame by a series of nails, introduced from under the drip deflector, requires a completion of this operation prior the window frame is installed in a building wall.

U.S. Pat. No. 3,845,599, granted Nov. 5, 1974 to Jolly, describes a "Window drain valve" wherein the recesses, which accommodate the panes in an extruded aluminum window frame, may be drained. Means are provided to prevent water draining from the recesses to enter into the building in adverse wind conditions. This is achieved by the provision of a drain valve having an inflow compartment and an outflow compartment, separated by a depending web with a float valve in the inflow compartment. The latter named valve closes the communication between the window sill recess and the drain valve, when the outlet of the outflow compartment is subjected to external wind pressure. This window drain can be considered as having two disadvantages. First, the use of valves renders the device very complicated. Second, the reliability of the system is quite questionable, especially in severe meteorological conditions.

U.S. Pat. No. 4,555,882, granted Dec. 3, 1985 to Moffitt et all for a "Moisture guard for window frames, door jambs and the like" discloses a device for preventing water damage to the interior of a building, caused by moisture, leaks, rain, snow or the like. The moisture guard comprises a metallic facing fixed to a plastic molding. The sill of a window frame is seated on the metallic facing. An integrally formed upstanding rear flange is located at the rear edge of the base and an integrally formed depending front flange is disposed at the forward edge of the base. At each end of the base is located an integrally formed upstanding end flange that embraces the adjacent window structure. The end flange has a vertical end wall and a vertical side wall. There are two basic disadvantages to this moisture guard design. First, the sill of the window rests directly on the metal facing and, thus, no space for water collection is provided. Second, the metal facing is not provided with a sloping surface for drainage.

International Application WO 98/32942, published Jul. 30, 1998 under the Patent Cooperation Treaty, for a "Diverter for wall drainage", inventors Burroughs et al, describes a diverter positioned directly beneath a wall component. The diverter includes an upper surface that slopes toward the wall exterior, a plurality of downwardly sloped channels and a cover over the outer ends of the ribs which form the channels. The cover forms drainage openings at the ends of the channels. Two important shortcomings characterize this diverter. First, no back and lateral flanges, to confront the juxtaposed elements of the window structure, are provided. Second, the structure is not unitary formed, a separate cover being used.

SUMMARY OF THE INVENTION

There is, accordingly, a need for a window drain which overcomes the disadvantages of the prior art.

It is the primary objective of the present invention to provide a window drain which is efficient and reliable.

It is another objective of the present invention to provide a window drain, well engineered, forming a one piece structure.

It is yet another objective of the present invention to provide versatile window drains, adaptable to be assembled with standard windows having different widths and lengths.

The present invention is directed, in a first variant, to a window drain adaptable to be positioned beneath a sill window. The window comprises, besides the sill, opposed jambs and a window flange. The window drain includes a base having a substantially rectangular shape in plane with a horizontally extending lower surface and a sloping downwardly and outwardly upper surface. The base also incorporates a front flange, which projects perpendicularly and downwardly from the front edge of the base, and an upstanding rear rib, situated at the rear edge of said base, from which it extends perpendicularly. The base also comprises an end flange, located at each lateral edge of the base. The end flange includes an upstanding end wall projecting from the lateral edge, and a front wall coplanar with the front flange and extending upwardly and downwardly from the base. The base is also provided with supports, spacedly disposed on the sloping downwardly and upwardly upper surface. The supports have their tops coplanar. On the front flange are disposed several spacers having their outsurfaces coplanar. The window drain, as disclosed, is adaptable to accommodate a window having a width, measured between the back of the sill and the back of the window flange, equal to the distance between the front face of the upstanding rear rib and the outsurfaces of the spacers.

The present invention is also directed, in a second embodiment, to a window drain adaptable to be positioned beneath the sill of a window. The window comprises, the sill, opposed jambs and a window flange. The window drain has a substantially rectangular shape in plan and includes a base with a horizontally extending lower surface and a sloping downwardly and outwardly upper surface. The base is also provided with a front flange projecting perpendicularly and downwardly from the front edge. The base incorporates, as well, an upstanding rear rib, situated proximate to the back edge of the base, from which it extends perpendicularly. The upstanding rear rib is provided with several spaced apertures along its length. The base also includes a supplementary rear rib, situated behind and parallel to the upstanding rear rib, and projecting from the back edge of the base. At each lateral edge of the base, there is an end flange adaptable to be attached to a vertical element of the window structure. The end flange comprises an upstanding end wall, projecting from the lateral edge, and a front wall coplanar with the front flange. The front wall extends upwardly and downwardly from the base. Each end flange is provided with openings adaptable to use attachment elements for securing the window drain, when installed. The base contains, as well, window supports, spacedly disposed on the sloping downwardly and outwardly upper surface. The tops of the window supports are coplanar with the top of the upstanding rear rib. The top of the supplementary rear rib is relatively higher than the top of the upstanding rear rib. Spacers are disposed on the front flange. The window drain, according to this variant, is so designed, that the distance between the supplementary rear rib and the front faces of said spacers is adaptable to accommodate a window having the widest standard width, respectively the largest distance between the back edge of the sill and the back of the window flange. The window drain is also so designed, that the distance between intermediary lines, situated between the supplementary rear rib and the upstanding rear rib, on one side, and the front faces of the spacers, on the other side, are adaptable to accommodate windows of intermediary widths, respectively intermediary distances between the back edge of the sill and the back of the window flange.

The present invention is directed, in yet another embodiment, to a window drain adaptable to be positioned beneath a sill of a window. The window comprises, the sill, opposed jambs and a window flange.

The window drain has a substantially rectangular shape in plan and includes a base with a horizontally extending lower surface and with a sloping downwardly and outwardly upper surface. The base is also provided with a front flange projecting perpendicularly and downwardly from the front edge of the base. The base is provided, as well, with an upstanding rear rib, situated proximate to the back edge of the base, from which it extends perpendicularly. A supplementary rear rib, situated behind and parallel to the upstanding rear rib and projecting from the back edge of the base is also provided. At each lateral edge of the base, there is an end flange which comprises an upstanding end wall projecting from the lateral edge and a front wall coplanar with the front flange and extending upwardly and downwardly from the base. Each of the end flanges is provided with openings adaptable to use attachments for securing the window drain when installed. Use is made of window supports, which are spacedly disposed on the sloping downwardly and outwardly upper surface and have its coplanar tops. Spacers are provided on the front flange. The tops of the upstanding rear rib and supplementary rear rib are coplanar and relatively higher than the tops of the window supports.

Conveniently, the window drain, described above, can be used with a window having the narrowest standard width. In this case, the supplementary rear rib, together with the part of the base between the upstanding rear rib and the supplementary rear rib, are cut and discarded. Thus, when the window is installed, the back of the sill abuts and confronts the front of the upstanding rear rib.

Optionally, when the above described window drain is used with a window having an intermediary width, the height of the upstanding rear rib is reduced by cutting it to the level of the tops of the window supports. Several spaced apertures, disposed along the length of the upstanding rear rib are used in this embodiment.

Optionally, the window supports stretch outwardly from the upstanding rear rib up to just beyond the front edge of the base, where they form front ends, coplanar with the spacers.

Conveniently, the above window supports are each provided, adjacent the upstanding rear rib with a recess. All formed recesses are linearly located and adaptable to be used to lodge a compressible cord.

Optionally, each of the support means has a truncated cone form.

BRIEF DESCRIPTION OF THE SEVERAL VIEWS OF THE DRAWINGS

Although the characteristic features of the invention will be particularly pointed out in the claims, the invention itself, and the manner in which it may be made and used, may be better understood by referring to the following description taken in connection with the accompanying drawings, forming part thereof, wherein like reference numerals refer to like parts, throughout the several views in which:

DESCRIPTION OF THE INVENTION AND PREFERRED EMBODIMENTS

Figure 1:
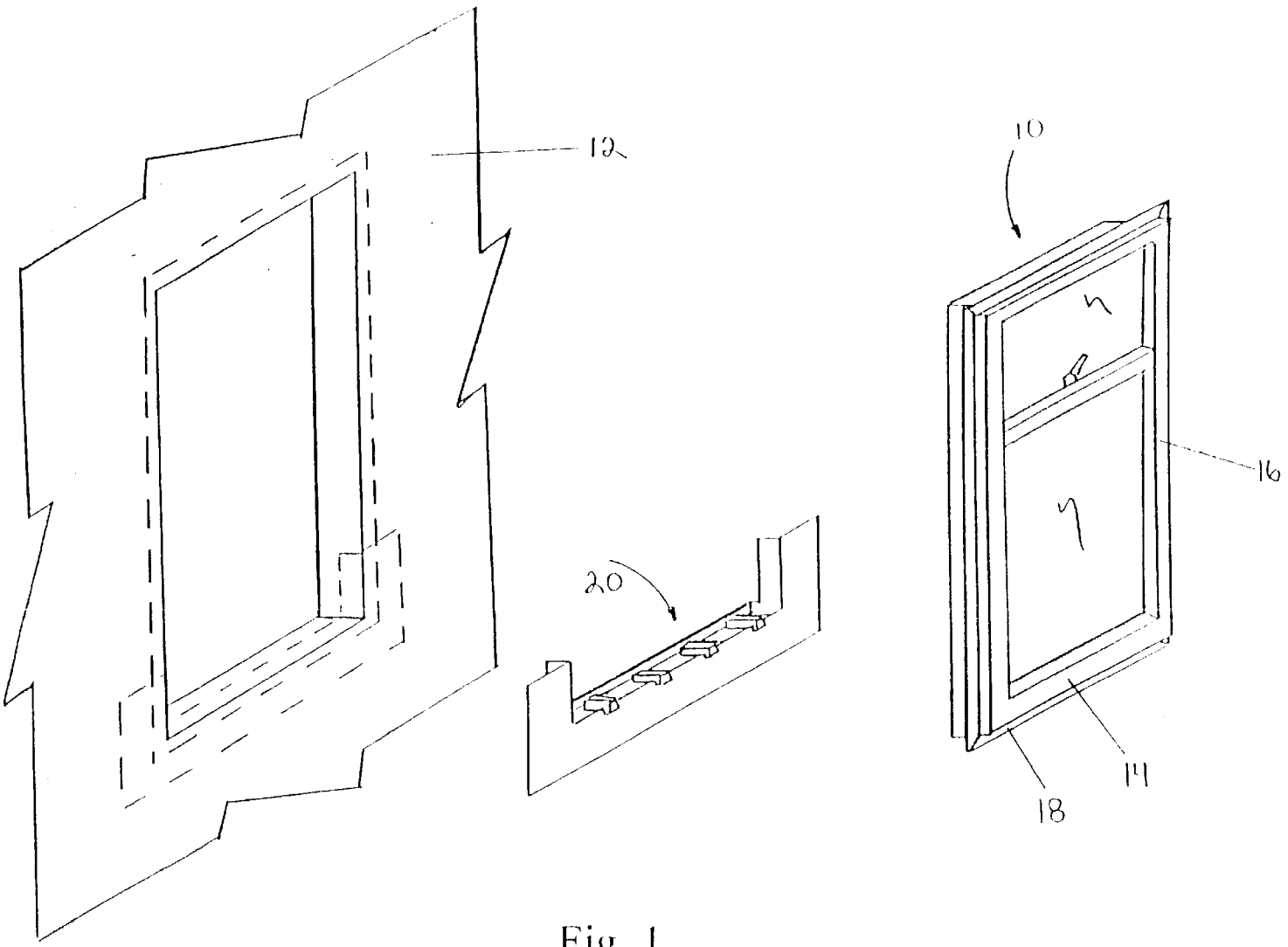
FIG. 1 illustrates a perspective view, in spaced relation, of a window drain together with a window and a building wall.

Referring now to the drawings, and initially to FIG. 1, there is shown a window 10 ready to be mounted in a building wall 12. Window 10 comprised a sill 14, opposed jambs 16 and a window flange 18.

Figure 2:
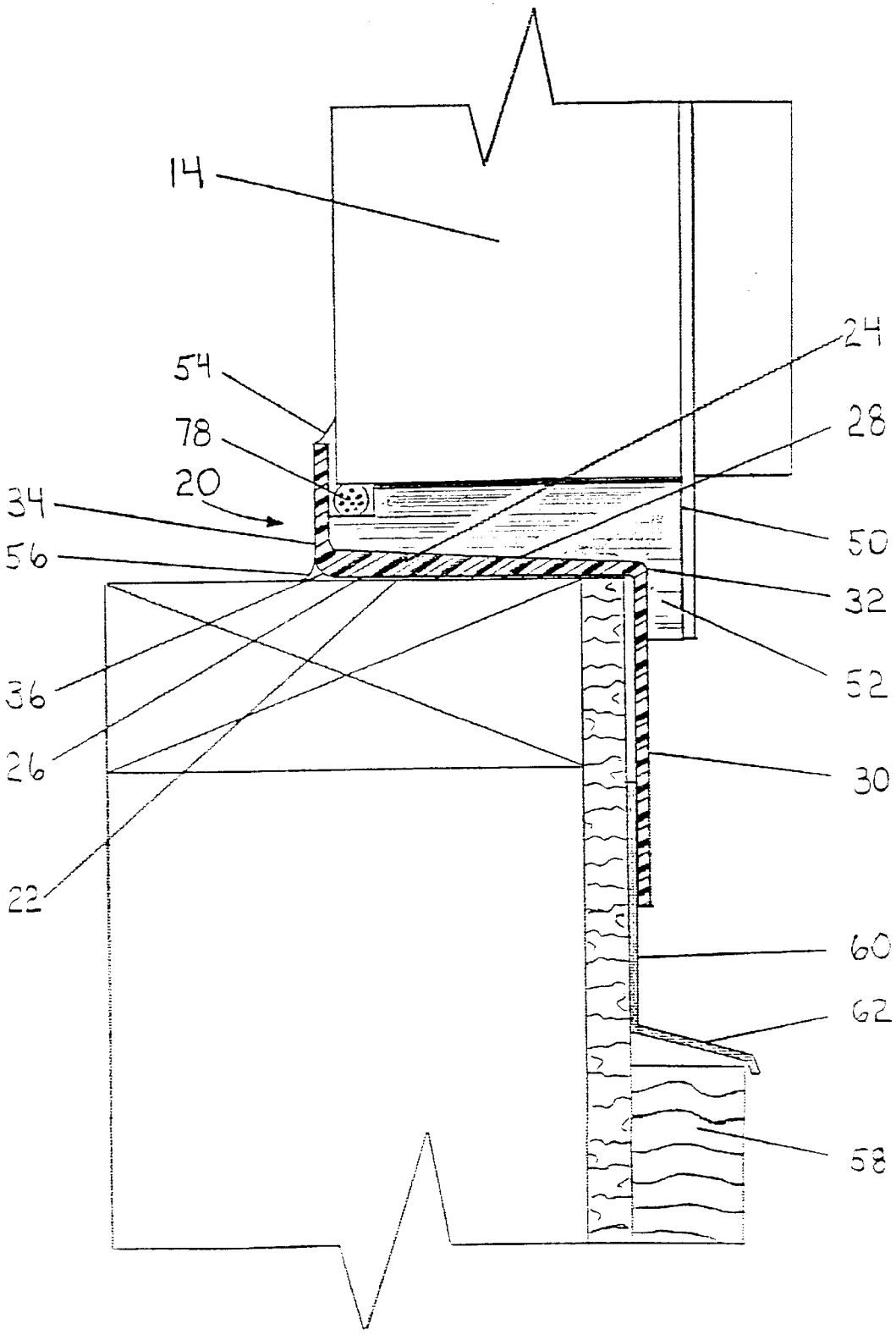
FIG. 2 illustrates a vertical section view of the window drain according to the first embodiment of the present invention.
Figure 3:
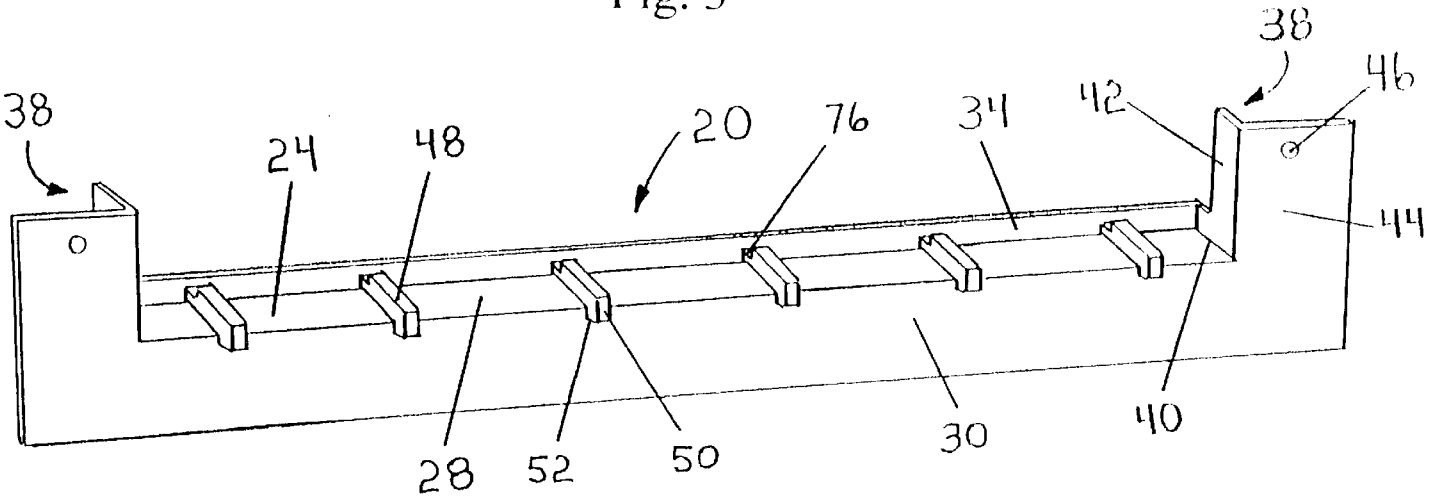
FIG. 3 illustrates a perspective view of the window drain according to the first embodiment.
Figure 3A:
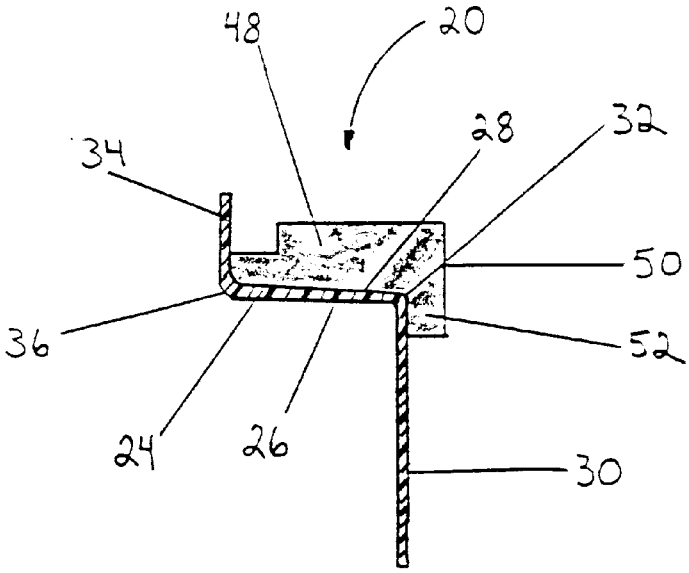
FIG. 3A illustrates a diagrammatical representation of the window drain according to the first embodiment.

With reference to the FIGS. 2, 3 and 3A, there is shown in a first embodiment, a window drain, generally indicated at 20. The latter is positioned beneath sill 14 and is seated on a paper flashing 22.

Window drain 20, which is advantageously formed by molding, comprises a base 24 having a horizontally extending lower surface 26 and a sloping downwardly and outwardly upper surface 28. Base 24 has a substantially rectangular shape in plan. Horizontally extending lower surface 26 of base 24 lies directly on paper flashing 22.

A front flange 30 projects perpendicularly and downwardly from the front edge 32 of base 24. Front flange 30 is integrally formed with base 24 and abuts against paper flashing 22. The latter extends from under base 24 and is disposed on building wall 12.

An upstanding rear rib 34 is situated at the rear edge 36 of base 24, from which it extends perpendicularly and upwardly and with which it is integrally formed.

An end flange 38 is located at each lateral edge 40 of base 24 and is integrally formed with the latter. Each end flange 38 embraces a vertical element of the window structure (not shown) and comprises an upstanding end wall 42, projecting upwardly from lateral edge 40, and a front wall 44, coplanar with front flange 30 and extending upwardly and downwardly from base 24. Front wall 44 is provided, in its upwardly extending part, with openings 46 through which nails or screws may be passed and driven, to firmly secure window drain 20 to the window structure (not shown).

Several window supports 48 are spacedly disposed on sloping downwardly and outwardly upper surface 28 and stretch out forwardly from and perpendicularly to upstanding rear rib 34. Window supports 48 extend up to beyond front edge 32 of base 24, where they form front ends 50. The latter are continued downwards by spacers 52 with which they have coplanar outsurfaces. The top of upstanding rear rib 34 is relatively higher than the tops of window support 48.

Windows 10 come in standard widths and window drain 20 of the present invention would be commensurable with a standard window having a determined width.

After window drain 20 has properly been installed, window 10 is placed on it, so that its sill 14 rests on windows supports 48 and its back abuts upstanding rear rib 34. Concomitantly, window flange 18 contacts front ends 50 and spacers 52 and thus, it is kept at a certain distance from front flange 30 and, thereby, gaps are formed.

Window drain 20 is rendered watertight by the provision of caulking seams, respectively, an upper 54 and a lower 56. Upper caulking seam 54 is provided between the upper part of upstanding rear rib 34 and the adjacent part of sill 14. Lower caulking seam 56 is provided between base 24 and the adjacent window structure.

The water collected in the compartments formed by upstanding rear rib 34 and window supports 48 is diverted outwardly and downwardly through the above described gaps. To protect a siding 58 which covers the front of a building from drained water, a counterflashing 60 is provided. The latter is attached beneath the lower part of front flange 30. An extension 62 of counterflashing 60 is directed outwardly and downwardly from siding 58.

Window drain 20, described in this embodiment, is produced with a determined width, but may be adapted, in situ, for different lengths. This can be achieved, basically, by cutting window drain 20 in two and adding or removing a segment.

Optionally, window drain 20 can be molded in two entities: a left side and a right side, which can be joined together.

Figure 4:
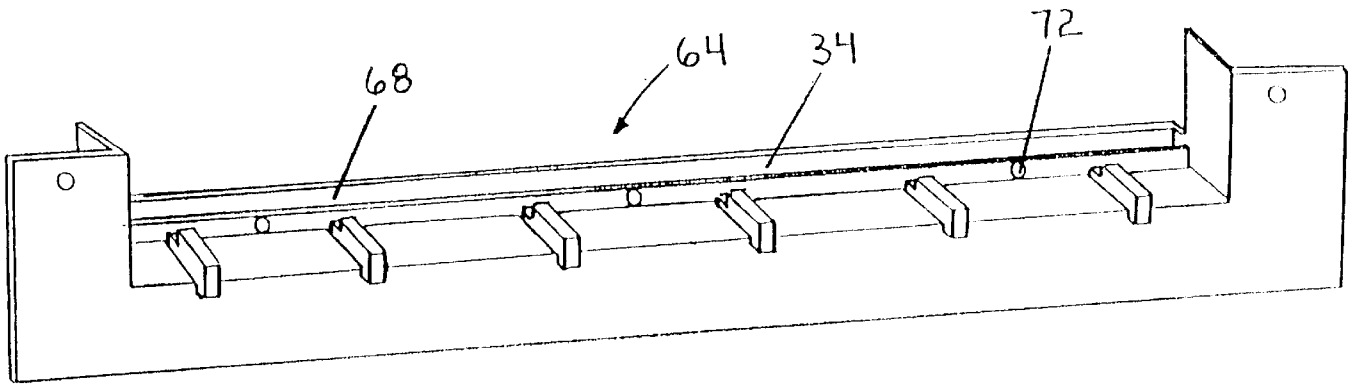
FIG. 4 illustrates a perspective view of the window drain according to the second embodiment.
Figure 4A:
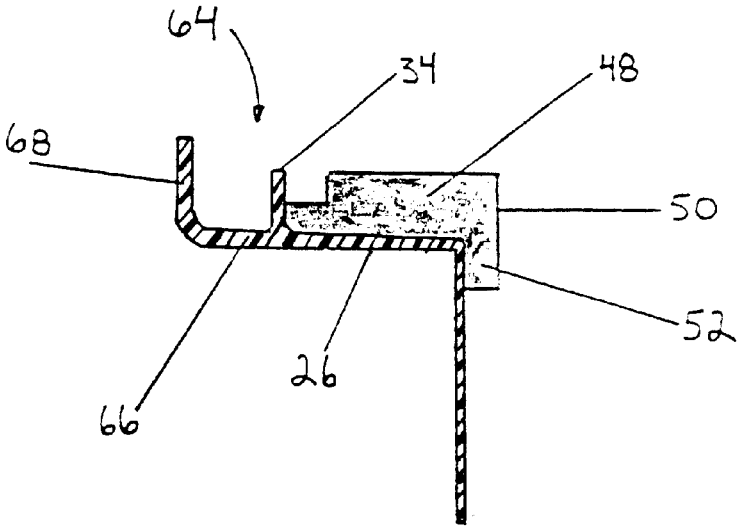
FIG. 4A illustrates a diagrammatical view of the window drain according to the second embodiment.

In a second embodiment, shown diagrammatically in FIGS. 4 and 4A, window drain 64 is designed to accommodate windows 10 of different standard widths. To this end, the above described embodiment is modified as follows: a base 66, wider than base 24, is used. Base 66 incorporates a supplementary rear rib 68. The latter is situated behind and parallel to upstanding rear rib 34 and projects outwardly from the back edge of base 24. In this embodiment the top of upstanding rear rib 34 is coplanar with the tops of window supports 48, while the top of supplementary rear rib 68 is relatively higher. The distance between supplementary rear rib 68 and front ends 50 or spacers 52 is adaptable to accommodate a window 10 having the widest standard width, respectively the largest distance between the back edge of sill 14 and the back face of window flange 18.

Distances between intermediary lines situated between rear rib 68 and upstanding rear rib 34, on one side, and front ends 50 or the front faces of spacers 52, on the other side, are adaptable to accommodate windows 10 of intermediary distances between the back edge of sill 14 and the back of window flange 18. When the back edge of sill 14 is situated anywhere behind upstanding rear rib 34 including even direct contact with supplementary rear rib 68, an upper caulking seam 54, formed substantially between the lower edge of sill 14 and the top of supplementary rear rib 68, is used.

When the lower edge of sill 14 is situated on an intermediary line, as described above, water collected in a U-channel, formed by supplementary rear rib 68, upstanding rear rib 34 and base 24, is drained towards the exterior of the building. To this end, upstanding rear rib 34 is provided with several spaced apertures 72, disposed along its length. Apertures 72 start at the level of sloping downwardly and outwardly upper surface 28 and have a relatively limited upward extension. They are formed by exerting a limited force on zones corresponding to the apertures. These zones are of reduced mechanical strength.

Figure 5:
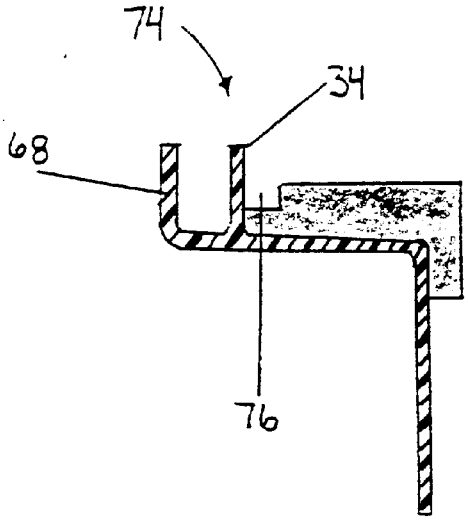
FIG. 5 illustrates a diagrammatical view of the window drain according to the third embodiment.

In a third embodiment shown in FIG. 5, a window drain 74 is adaptable to accommodate, in situ, windows 10 of different standard widths. To this end, the above described embodiment is modified as follows: upstanding rear rib 34 and supplementary rear rib 68 are provided with coplanar tops, which are relatively higher than the tops of window supports 48. When a window drain 74 is used for a window 10 having the narrowest standard width, supplementary rear rib 68 together with the part of base 24, between upstanding rear rib 34 and supplementary rear rib 68, are cut and discarded. In this case, the back of sill 14 abuts upstanding rear rib 34. A corresponding upper caulking seam 54 is used.

When a window 10 having an intermediary or the largest standard width is used, the height of upstanding rear rib 34 is reduced by cutting the latter to the level of the tops of window supports 48. Thus, a corresponding part of upstanding rear rib 34 is cut and discarded. Obviously, in this case use is made of apertures 72.

Alternatively to window supports 48, which stretch forwardly from and perpendicularly to upstanding rear rib 34, separate window supports which do not extend from the latter and do not project beyond front edge 32 of base 24 can be used. Thus, spaced apart window supports, each having, for example, a truncated cone form (not shown in the drawings) can be employed.

Conveniently, when use is made of window supports 48, in order to enhance the watertightness of the assembly, formed of sill 14 of window 10 and either one of window drains 20, 64 and 74, each window support 48 is provided, adjacent to upstanding rear rib 34, with a recess 76. Thus, several recesses 76, linearly located are formed and can be used to lodge a compressible cord 78, as a compression-type static seal, between the bottom surface of sill 14 and upstanding rear rib 34. This sealing is supplementary to upper and lower caulking seams 54 and 56.

As required, detailed embodiments of the present invention are disclosed herein, however, it is to be understood that the disclosed embodiments are merely exemplary of the invention which may be embodied in differed forms. Therefore, specific structural and functional details disclosed herein are not to be interpreted as limiting, but merely as a basis for the claims and as representative basis for teaching one skilled in the art to variously employ the present invention in virtually any appropriately detailed structure.

The embodiments of the invention in which an exclusive property or privilege is claimed are defined as follows:

1. Window drain, adaptable to be positioned beneath a sill of window, window drain comprising said sill, opposed jambs and a window flange, said window drain including a base having a horizontally extending lower surface and a sloping downwardly and outwardly upper surface, said base having a substantially rectangular shape in plan;

a front flange projecting perpendicularly and downwardly from a front edge of said base;

an upstanding rear rib situated at a rear edge of said base from which it perpendicularly extends;

an end flange, located at each lateral edge of said base, comprising an upstanding end wall projecting from said lateral edge and a front wall coplanar with said front flange and extending upwardly and downwardly from said base, each of said end flanges being provided with openings adaptable to use attachment means for securing to a vertical stud of a window frame, when installed;

window support means, spacedly disposed on said sloping downwardly and outwardly upper surface and having coplanar tops; and said window drain being adaptable to accommodate a window having a width, measured between the back of said sill and the back of said window flange, equal to the distance between the front face of said upstanding rear rib and said outsurfaces of said spacers.

2. Window drain, adaptable to be positioned beneath a sill of a window, window drain comprising, said sill, opposed jambs and a window flange, said window drain including a base having a horizontally extending lower surface and a sloping downwardly and outwardly upper surface, said base having a substantially rectangular shape in plan;

a front flange projecting perpendicularly and downwardly from a front edge of said base;

an upstanding rear rib, situated proximate to a back edge of said base from which it perpendicularly extends, said upstanding rear rib being provided with several spaced apertures along its length;

a supplementary rear rib, situated behind and parallel to said upstanding rear rib and projecting from said back edge of said base;

an end flange, located at each lateral edge of said base, and comprising an upstanding end wall, projecting from said lateral edge, and a front wall coplanar with said font flange and extending upwardly and downwardly from said base, each of said end flanges being provided with openings adaptable to use attachment means for securing said window drain when installed;

window support means, spacedly disposed on said sloping downwardly and outwardly upper surface and having tops coplanar with the top of said upstanding rear rib, the top of said supplementary rear rib being relatively higher; and spacers disposed on said front flange;

said window drain is so designed, that the distance between said supplementary rear rib and the front faces of said spacers is adaptable to accommodate a window having the widest standard width, respectively the largest distance between the back edge of said sill and the back of said window flange; and said window drain is also so designed, that the distances between intermediary lines, which are situated between said supplementary rear rib and said upstanding rear rib, on one side, and the front faces of said spacers, on the other side, are adaptable to accommodate windows of intermediary widths, respectively intermediary distances between the back edge of said sill and the back of said window flange.

3. Window drain, adaptable to be positioned beneath a sill of a window, and comprises, said sill, opposed jambs and a window flange, said window drain including a base having a horizontally extending lower surface and a sloping downwardly and outwardly upper surface, said base having a substantially rectangular shape in plan;

a front flange projecting perpendicularly and downwardly from a front edge of said base;

an upstanding rear rib, situated proximate to a back edge of said base from which base it perpendicularly extends;

a supplementary rear rib, situated behind and parallel to said upstanding rear rib and projecting from said back edge of said base;

an end flange located at each lateral edge of said base, each said end flange, comprising an upstanding end wall projecting from said lateral edge and a front wall coplanar with said front flange and extending upwardly and downwardly from said base, each of said end flanges being provided with openings adaptable to use attachment means for securing said window drain when installed;

window support means, spacedly disposed on said upper surface and having its tops coplanar;

spacers disposed on said front flange; and the tops of said upstanding rear rib and supplementary rear rib being coplanar and relatively higher than the tops of aid window support means.

4. Window drain, as defined in claim 3, wherein when said window drain is used with a window having the narrowest standard width, said supplementary rear rib together with the part of said base between said upstanding rear rib and said supplementary ear rib are cut and discarded, whereby, when said window is installed, the back of said sill abuts the front of said upstanding rear rib.

5. Window drain, as defined in claim 3, wherein when said window drain is used with a window having an intermediary width, or the largest standard width, the height of said upstanding rear rib is reduced by cutting it to the level of the tops of said window support means, while several spaced apertures are provided along the length of said upstanding rear rib.

6. Window drain, as defined in claim 1, wherein said support means comprises several window supports located on said upper surface and stretching out forwardly from said upstanding rear rib up to just beyond said front edge of said base, where they form front ends, coplanar with said spacers.

7. Window drain, as defined in claim 6, wherein said window supports are each provided, adjacent said upstanding rear rib, with a recess, thus several recesses are linearly located and are adaptable to lodge a compressible cord for enhancing the watertightness between said sill and said upstanding rear rib.

8. Claim as defined in claim 2 wherein said support means has each a truncated cone form.

* * * * *